US006758617B2

(12) United States Patent
Sakaoka

(10) Patent No.: US 6,758,617 B2
(45) Date of Patent: Jul. 6, 2004

(54) SIDE KNOCKING-TYPE WRITING INSTRUMENT

(75) Inventor: Gouji Sakaoka, Yokohama (JP)

(73) Assignee: Micro Co., Ltd., Tokyo (JP)

( * ) Notice: Subject to any disclaimer, the term of this patent is extended or adjusted under 35 U.S.C. 154(b) by 0 days.

(21) Appl. No.: 10/227,718

(22) Filed: Aug. 26, 2002

(65) Prior Publication Data

US 2004/0037610 A1 Feb. 26, 2004

(51) Int. Cl.[7] ..... B43K 21/22; B43K 21/00
(52) U.S. Cl. ..... 401/92; 401/85; 401/82
(58) Field of Search ..... 401/92, 67, 82, 401/88, 93, 94, 109, 112, 113

(56) References Cited

U.S. PATENT DOCUMENTS

| | | | | |
|---|---|---|---|---|
| 3,181,507 A | * | 5/1965 | Dannebaum | 401/92 |
| 3,813,176 A | * | 5/1974 | Kamo | 401/92 |
| 3,883,253 A | | 5/1975 | Naruse et al. | 401/65 |
| 4,955,739 A | * | 9/1990 | Kageyama et al. | 401/65 |
| 5,139,356 A | * | 8/1992 | Shimada | 401/65 |

FOREIGN PATENT DOCUMENTS

| | | |
|---|---|---|
| JP | 3-56387 | 12/1991 |

* cited by examiner

*Primary Examiner*—David J. Walczak
(74) *Attorney, Agent, or Firm*—Adams & Wilks

(57) ABSTRACT

A side knocking-type writing instrument has a barrel having a longitudinal axis, a front end, and a rear end. A sliding member is disposed in the barrel for undergoing forward and rearward sliding movement along the longitudinal axis of the barrel. The sliding member has a shoulder comprised of a generally L-shaped side wall having a first wall portion extending along the longitudinal axis and a second wall portion extending transversely to the longitudinal axis. A knocking member undergoes pivotal movement in a direction transverse to the longitudinal axis of the barrel about a fulcrum point disposed at a rear portion of the knocking member. The knocking member has a pressing portion disposed at a front portion thereof. A linking pawl is disposed between the knocking member and the sliding member for undergoing pivotal movement therebetween and axial movement along the longitudinal axis. The linking pawl has an outward end disposed in contact with the pressing portion of the knocking member and an inward end disposed in contact with the shoulder of the sliding member.

13 Claims, 4 Drawing Sheets

SIDE KNOCKING-TYPE WRITING INSTRUMENT

BACKGROUND OF THE INVENTION (1) Field of the Invention

The present invention relates generally to mechanical pencils and, more specifically, to a side knocking-type writing instrument in which a writing component can be protruded from a front end of a barrel only by pressing a knocking member disposed at a side face of the barrel.

(2) Background of the Invention

As a knocking-type mechanical pencil or a knocking-type ballpoint pen, a side knocking-type writing instrument in which protrusion and retraction operations of a writing component are made with a knocking member, such as a knocking button disposed on the side face of a barrel, has been known. In a conventional side knocking-type writing instrument, a sloped cam system has been used wherein, as described in U.S. Pat. No. 3,883,253, a sliding member is housed in a barrel in such a state that the sliding member is biased backwardly by a spring, a sloped cam is formed on the sliding member and a pressing portion of the knocking member is forced to abut on the sloped cam by which the sliding member is moved forward against the spring.

In the foregoing sloped cam system, the pressing force from the knocking member has a force component directed in the axial direction which contributes to the forward movement of the sliding member and a force component directed in the radial direction which presses the sliding member perpendicularly against the barrel. The force in the radial direction turns into a strong frictional resistance when the sliding member moves. However, when the sliding member moves forward, the spring is compressed, and the resilient power of the spring becomes large. Accordingly, the frictional resistance is even stronger and the knocking load increases, leading to a drawback that the conventional side knocking-type writing instrument cannot be operated with a small pressing force.

Japanese Utility Model Publication B-3-56387 discloses a side knocking-type mechanical pencil which is not operated by means of a sloped cam system. The knocking-type mechanical pencil disclosed in this publication has a mechanism wherein a push button is pressed so as to buckle each of intermediate hinge portions forwardly in an axial direction at a front linking position and a rear linking position of linking elements, thereby moving a lead chuck forwardly in the axial direction and feeding a lead. However, this mechanism has a complicated structure for buckling the intermediate hinge portions, whereby the number of parts is considerably increased, such being unfavorable from an economical standpoint. Further, it is also impossible to accommodate plural leads in the lead chuck.

U.S. Pat. No. 3,558,233 discloses a writing instrument wherein a cam is pivotably mounted on a barrel, and a sliding member is moved forward by rotating the cam by means of a knocking member. However, in this type of writing instrument, since the cam is fixed to the barrel with a rotating shaft and cannot be entirely transferred in an axial direction, the movement of the sliding member in the axial direction is restricted to the range of rotation of the cam and, therefore, it becomes difficult to increase the range of movement of the sliding member. Accordingly, in order to secure a desired predetermined movement of the sliding member in the conventional writing instrument, the movement of the knocking member is required to be large or the cam is required to be formed on a large scale, whereby the structure of the writing instrument becomes complicated.

The present invention overcomes many of the disadvantages inherent in conventional side knocking-type writing instruments.

SUMMARY OF THE INVENTION

It is an object of the present invention to provide a side knocking-type writing instrument which is simple in construction and in which the knocking operation of the knocking member can be effected with a small pressing force.

It is another object of the present invention to provide a side knocking-type writing instrument in which the sliding member can be slid within a large range of movement when the knocking member is knocked.

Still another object of the present invention is to provide a side knocking-type writing instrument which is easy to be assembled, simple in construction and can be manufactured at a low cost.

In order to accomplish these objects, there is provided according to the present invention a novel and improved side knocking-type writing instrument having a barrel having a longitudinal axis, a front end, and a rear end. A sliding member has a writing component and is disposed in the barrel for undergoing forward and rearward sliding movement along the longitudinal axis. A knocking member is disposed on a side surface of the barrel for undergoing movement in a direction transverse to the longitudinal axis of the barrel. A linking pawl is disposed between the knocking member and the sliding member for undergoing pivotal movement therebetween and axial movement along the longitudinal axis. The linking pawl has an outward end disposed in contact with a pressing portion of the knocking member and an inward end disposed in contact with a shoulder of the sliding member. When the pressing portion of the knocking member is pressed, the knocking member undergoes movement in the transverse direction so that the linking pawl is moved axially while being pivoted and the sliding member is slid forwardly to thereby protrude the writing component from the front end of the barrel.

In one embodiment, the linking pawl is bent in an approximately L-shaped form in side view, and the outward end of the linking pawl is disposed in a seat formed at the pressing portion of the knocking member. In another embodiment, the outward end of the linking pawl is connected to the pressing portion of the knocking member by means of a flexible hinge portion. The shoulder of the sliding member with which the inward end of the linking pawl is contacted is preferably generally L-shaped. The sliding member has a passageway hole in which plural writing components, such as pencil leads, can be accommodated.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings:

FIG. 1(A) is a partial cross-sectional view of a state where the knocking member is not pressed and FIG. 1(B) is a partial cross-sectional view of a state where the knocking member is pressed;

FIG. 3(A) is a side view and FIG. 3(B) is a front view of the knocking member;

FIG. 5(A) is a cross-sectional view taken along line 5(A)–5(A) of FIG. 1(A) and FIG. 5(B) is a cross-sectional view taken along line 5(B)–5(B) of FIG. 1(B); FIG. 6(A) is a cross-sectional view of a state where the knocking member is not pressed and FIG. 6(B) is a cross-sectional view of a state where the knocking member is pressed.

DETAILED DESCRIPTION OF THE PREFERRED EMBODIMENTS

Figure 1:
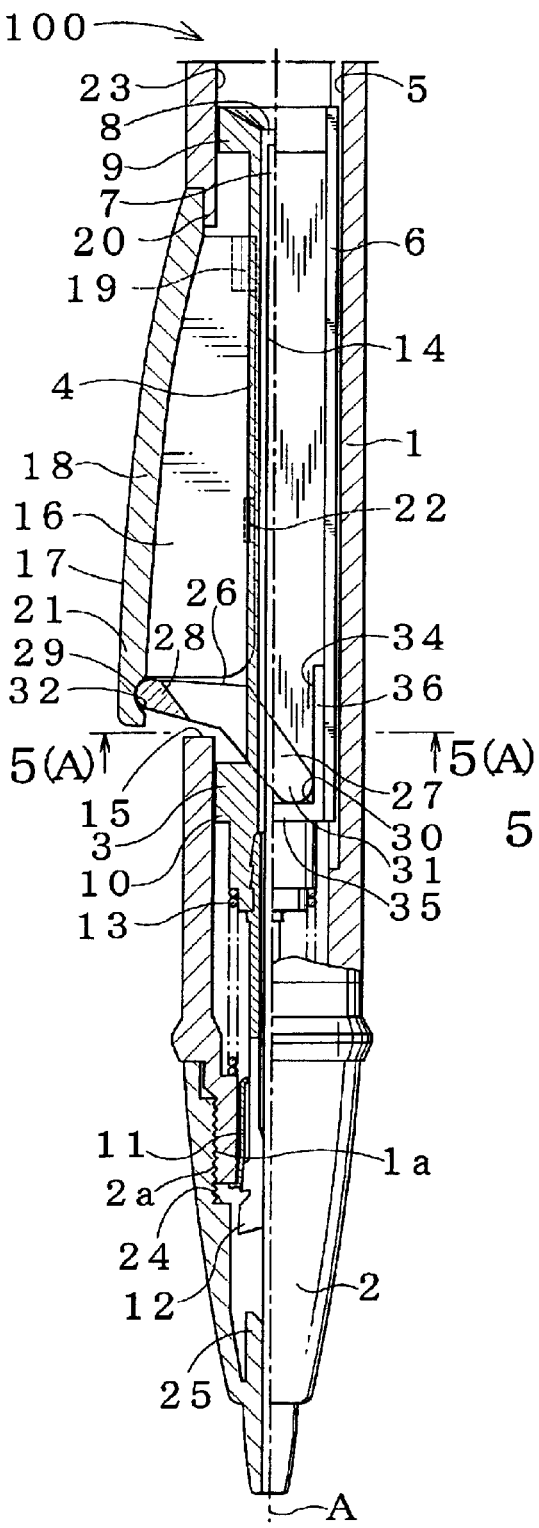
FIGS. 1(A)–1(B) show an embodiment of a side knocking-type writing instrument according to the present invention, where
Figure 1:
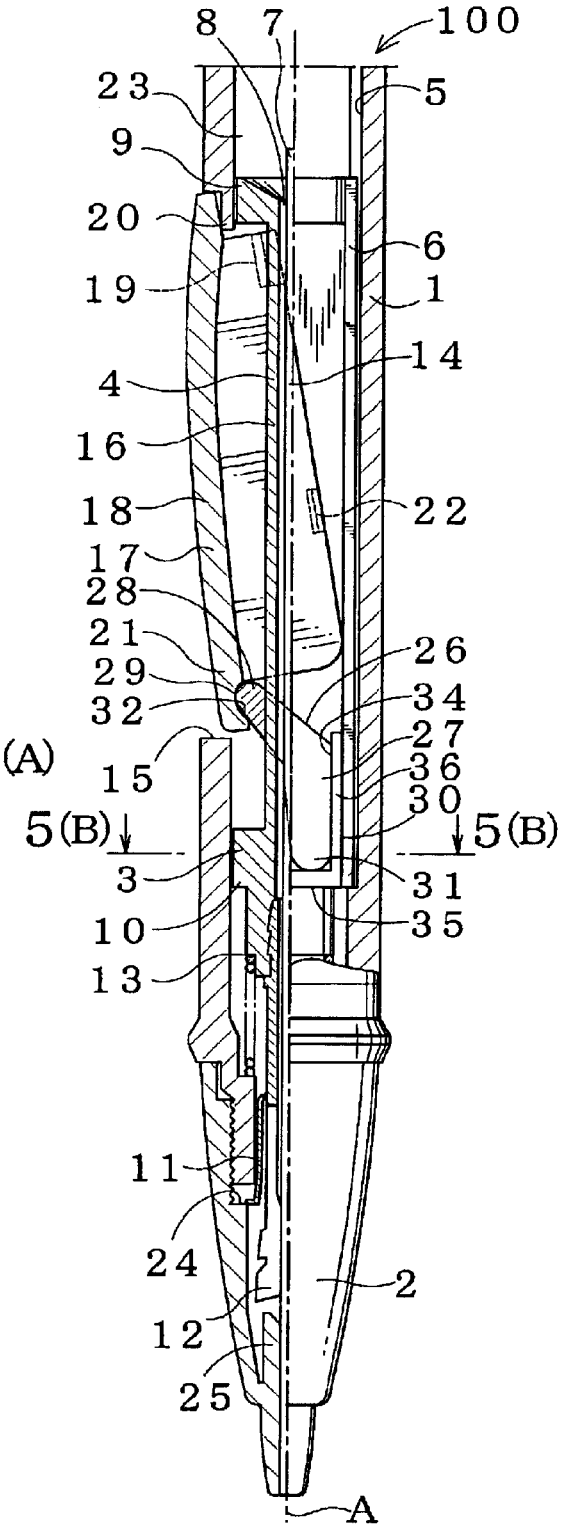

While this invention is susceptible of embodiments in many different forms, this specification and the accompanying drawings disclose some forms as examples of the use of the invention. The invention is not intended to be limited to the embodiments so described, and the scope of the invention will be pointed out in the appended claims.

Certain terminology is used in the following description for convenience only and is not intended to be limiting. The words inner, outer, inward, outward, rear, front, forward, rearward, upper, and lower designate directions in the drawing to which reference is made. Such terminology includes the words above specifically mentioned and words of similar import.

The preferred embodiment of the side knocking-type writing instrument according to the present invention is described below with a specific application to a side knocking-type mechanical pencil of which the writing component is a pencil lead. However, it will be appreciated by those of ordinary skill in the art that the present invention is also well adapted for other types of writing instruments, such as retractable pens, such as ballpoint pens.

Figure 2:
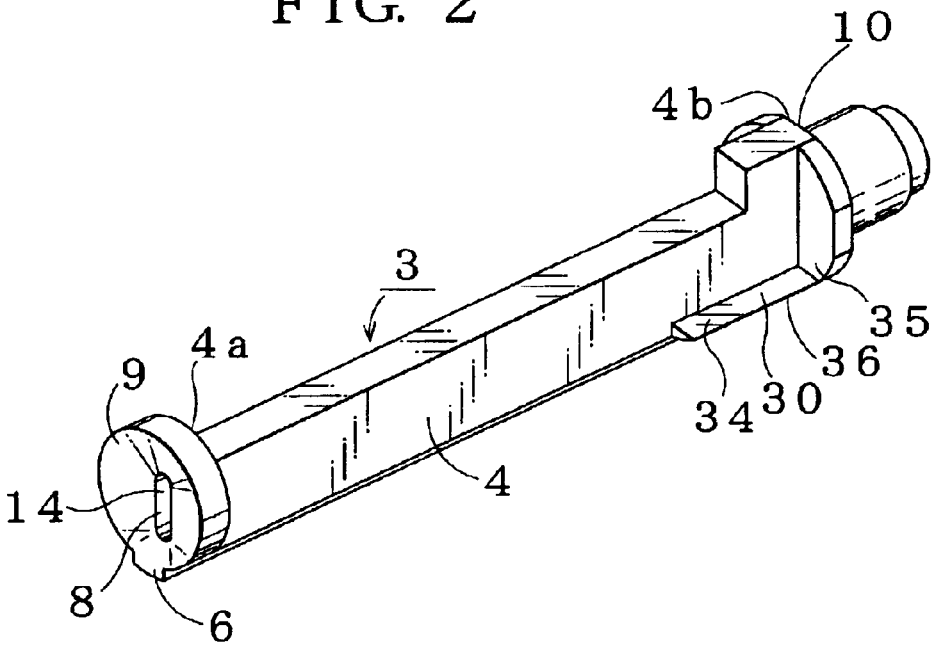
FIG. 2 is a perspective view of the sliding member shown in FIGS. 1(A)–1(B)

Referring now to the drawings in detail, wherein like numerals are used to indicate like elements throughout, there is shown in FIGS. 1(A)–1(B), 2, 3(A)–3(B), 4 and 5(A)–5(B) an embodiment of a side knocking-type writing instrument, generally designated at 100, according to the present invention. As shown in FIGS. 1(A)–1(B) and 2, a barrel or axial pipe 1 has at its front end a ferrule or front member 2 which is threadedly secured to the front end through correspondingly mating threads 1*a*, 2*a*. A lead tank 23 is disposed at a rear end of the axial pipe 1. A sliding member 3 is disposed inside the axial pipe 1 for undergoing forward and rearward sliding movement along a longitudinal axis A of the axial pipe 1.

As shown in FIG. 2, the sliding member 3 comprises a slider main body 4 having a generally rectangular shape in cross section, a projection 6 formed on a side surface of the slider main body 4 for engagement with a slide groove 5 formed in an inner wall of the axial pipe 1, a receiving plate 9 having a receiving port 8 for receiving a writing component, such as a lead 7, and disposed at a rear portion 4*a* of the slider main body 4, and a guide plate 10 disposed at a front portion 4*b* of the slider main body 4 for guiding the sliding movement of the sliding member along the longitudinal axis A of the axial pipe 1. The dimension and shape of the outer peripheral surface of the guide plate 10 and/or the receiving plate 9 is selected so that the sliding member 3 is permitted to slide against the inner wall of the axial pipe 1 but is prevented from undergoing rotation relative to the axial pipe 1. A clutch 11 and a chuck 12 which grasp the lead 7 are fixed to the front portion 4*b* of the slider main body 4. The sliding member 3 is biased rearwardly along the longitudinal axis A (i.e., toward the rear end of the axial pipe 1) by a spring 13. A lead passageway 14 for storing spare leads 7 extends through the slider main body 4 and communicates the receiving port 8 with the chuck 12. The front member 2 has a stepped portion 24 on which the clutch 11 abuts and a lead-holding portion 25 which frictionally holds the lead 7.

Figure 3A:
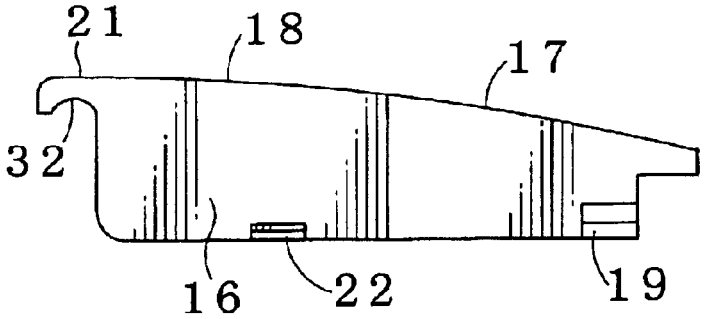
FIGS. 3(A)–3(B) show the knocking member shown in FIGS. 1(A)–1(B), where
Figure 3B:
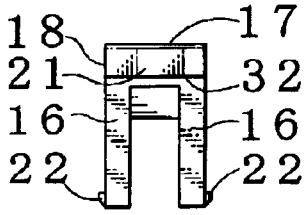

A knocking hole 15 is formed in a side surface of the axial pipe 1 facing the sliding member 3 for accommodating a knocking member 18. As shown in FIGS. 3(A)–3(B), the knocking member 18 is generally U-shaped in crosssection and has side plates 16, 16 and an upper plate 17. A projection 19 is formed at rear portions of the plates 16, 16, and a pressing portion 21 extends from a front portion of the knocking member 18. The pressing portion 21 has a seat 32 formed in the front portion of the top plate 17. By inserting the projection 19 into a receiving piece 20 formed at a rear edge of the knocking hole 15, the knocking member 18 can be moved slidably around a rear portion thereof as a fulcrum and the pressing portion 21 can be moved in a direction transverse to the longitudinal axis A. With respect to the outward direction, the pressing portion 21 can be moved up to the position where projections 22, each disposed at the outer face of respective ones of the side plates 16, 16, abut on an inner edge of the knocking hole 15.

Figure 4:
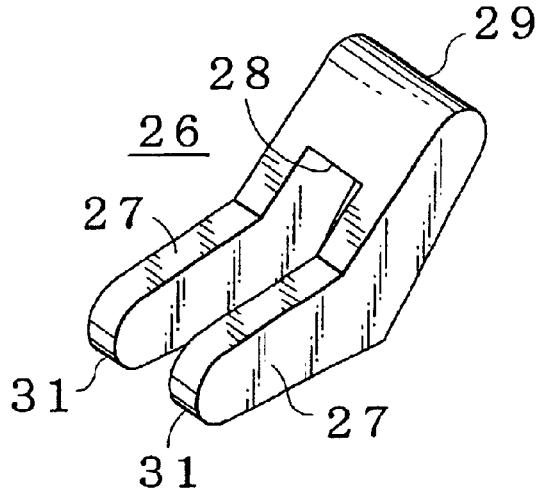
FIG. 4 is a perspective view of a linking pawl shown in FIGS. 1(A)–1(B)

A linking pawl 26 is disposed between the knocking member 18 and the sliding member 3 in a slanted or tilted condition. As shown in FIG. 4, the linking pawl 26 has a pair of leg pieces 27, 27 having a generally L-shaped form in side view, and a connecting part 28 connecting upper ends of the leg pieces 27, 27. Alternatively, each of the leg pieces 27 may have a generally linear shape. The connecting part 28 has an outward end 29 and each of the leg pieces 27 has an inward end 31. Each of the outward end 29 and inward ends 31 is generally arcuate-shaped. In the state of the side knocking-type writing instrument 100 shown in FIG. 1(B) where the knocking member 18 is pressed, the outward end 29 extends transversely to the longitudinal axis A and contacts the pressing portion 21 of the knocking member 18, and the inward end 31 of each of the leg pieces 27 extends along the longitudinal axis A and contacts a shoulder 30 of the sliding member 3.

Figure 6A:
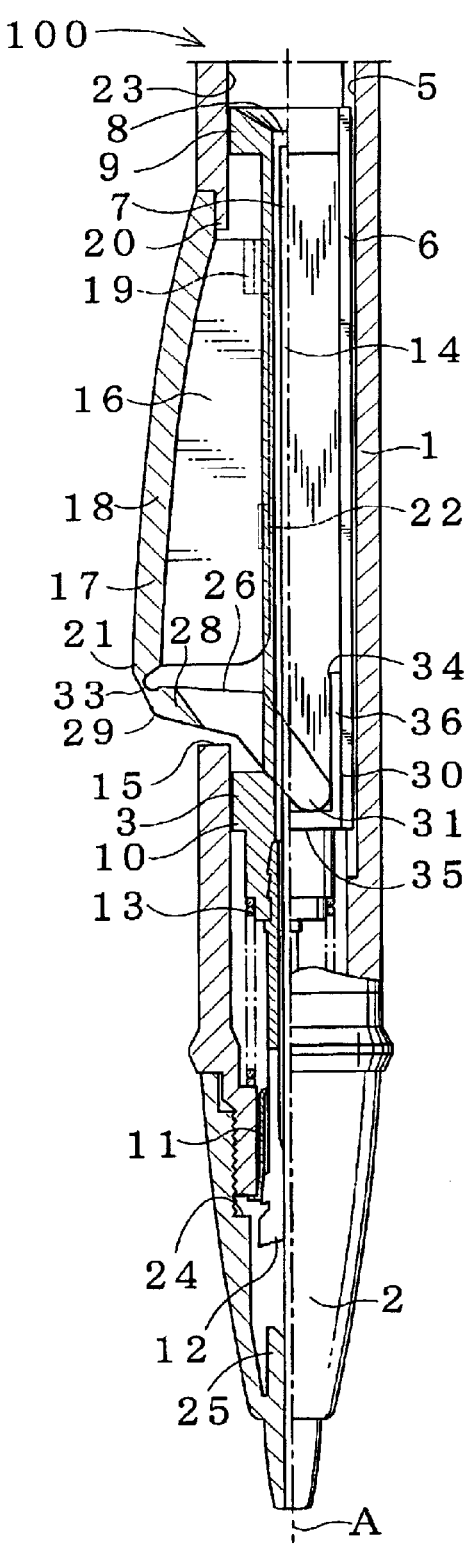
FIGS. 6(A)–6(B) show another embodiment of a side knocking-type writing instrument according to the present invention, where
Figure 6B:
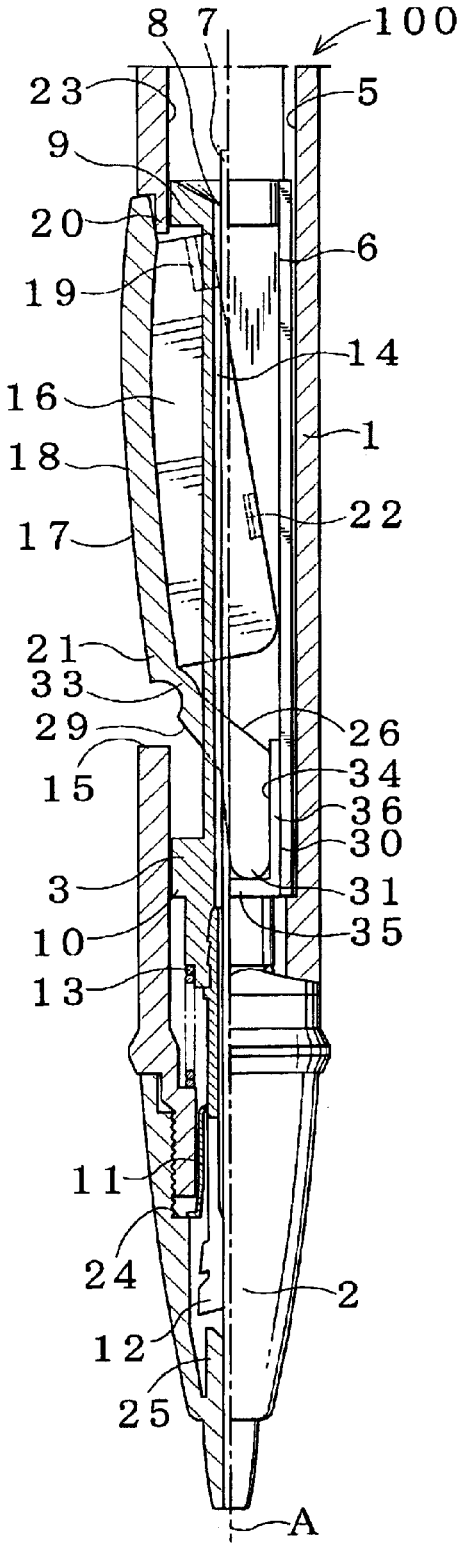

In the state of the side knocking-type writing instrument 100 shown in FIG. 1(B) where the knocking member 18 is pressed, and in the state of the side knocking-type writing instrument 100 shown in FIG. 1(A) where the knocking member 18 is not pressed, the outward end 29 of the connecting part 28 is rotatably fitted in the seat 32 of the knocking member 18. In an alternative embodiment, as shown in FIG. 6, the outward end 29 of the connecting part 28 may be joined with the top plate 17 of the knocking member 18 by means of a flexible hinge part 33.

The shoulder 30 of the sliding member 3 is disposed at opposite sides of the front portion of the slider main body 4 and away from the knocking member 18. The shoulder 30 comprises an L-shaped side wall 36 which is positioned forward of the pressing portion 21 of the knocking member 18 and which has a wall 34 extending along the longitudinal axis A in close proximity with the inner wall of the axial pipe 1, and a wall 35 extending transversely to the longitudinal axis A. The inward end 31 of each of the leg pieces 27 of the linking pawl 26 rotatably abuts on the corner portion of the side wall 36. In an alternative embodiment, the shoulder 30 may be joined to the inward end 31 of each of the leg pieces 27 by means of a flexible hinge portion (not shown).

Figure 5:
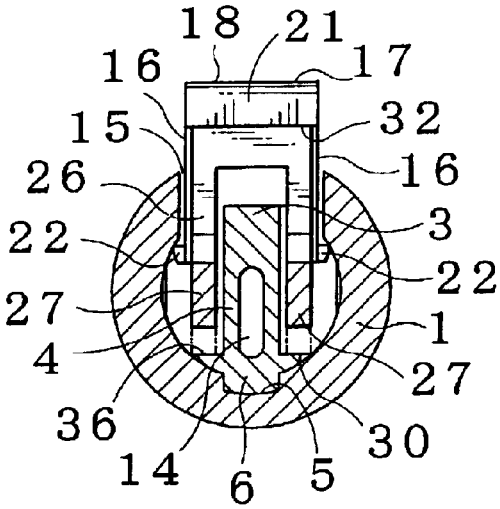
FIGS. 5(A)–5(B) are cross-sectional views of FIGS. 1(A)–1(B), where
Figure 5:
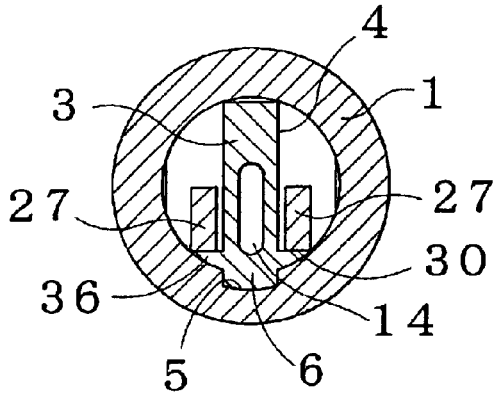

Referring to FIG. 5(A), the inward end 31 of each of the leg pieces 27 of the linking pawl 26 is inserted into the axial pipe 1 so that the leg pieces 27 are positioned at both sides of the slider main body 4 of the sliding member 3, and the outward end 29 of the linking pawl 26 is fitted in the seat 32 of the knocking member 18. Since the sliding member 3 is biased rearwardly by the spring 13, the knocking member 18 is pressed outwardly via the linking pawl 26. However, as described above, in the state shown in FIG. 1(A), the projections 22 disposed at the side plates 16 of the knocking member 18 abut on the inner edges of the knocking hole 15, whereby the knocking member 18 will not be disengaged from the knocking hole 15.

When the knocking member 18 is pressed from the state shown in FIG. 1(A), the outward end 29 of the linking pawl 26 is pivoted inwardly on its inward end 31 in a direction transverse to the longitudinal axis A and the linking pawl 26 is moved axially while being pivoted so that the sliding member 3 is slid forwardly against the force of the spring 13, whereby the lead 7 is pushed out of the ferrule 2 by the action of the chuck 12 in a known manner. By this operation, the lead 7 can be fed forwardly and it is possible to let the lead 7 extend out of the ferrule 2 to a desired length by repeating the above-described operation.

In the above-described operation, the slanting angle of the linking pawl 26 relative to the sliding member 3, i.e., the slanting or tilting angle of the linking pawl 26 to the wall 34 in the axial direction of the L-shaped side wall 36, becomes gradually smaller by the inward rotation of the outward end 29 of the linking pawl 26, whereby the frictional resistance between the inner wall of the axial pipe 1 and the sliding member 3 will be gradually reduced. The pressing force of the knocking member 18 is mostly directed to the component of force in the axial direction which contributes to the forward movement of the sliding member 3, and the knocking load thereby becomes lighter as compared with the conventional sloped cam system.

Furthermore, since the movement of the linking pawl 26 in the axial direction is a combination of two arcs, i.e., the rotation of the pressing portion 21 of the knocking member 18 and the rotation of the linking pawl 26, the axial movement of the linking pawl during a knocking operation is longer as compared with conventional writing instruments of the type wherein a cam is pivotably mounted on an axial pipe and a sliding member is pressed via the cam. Stated otherwise, since in the present invention the linking pawl is not fixed to the axial pipe, movement of the linking pawl in the axial direction is long during a knocking operation.

FIG. 6 shows another embodiment, wherein, as mentioned above, the outward end 29 of the linking pawl 26 is integrally joined with the top plate 17 of the knocking member 18 by means of the flexible hinge portion 33. The remaining structure of the side knocking-type writing instrument shown in FIG. 6 is as described above for FIGS. 1(A)–1(B). By this construction, when the knocking member 18 is pressed, the linking pawl 26 also rotates and at the same time moves in the axial direction, and the similar operation and effects can thereby be obtained as described above for the embodiment of FIGS. 1(A)–1(B).

In yet other alternative embodiments, the inward ends 31, rather than the outward end 29, of the linking pawl 26 may be flexibly joined with the shoulder 30 of the sliding member 3 by means of a hinge member, or both the outward end and the inward ends may be integrally joined by means of a hinge member.

By the foregoing construction of the side knocking-type writing instrument according to the present invention, a linking pawl is disposed in a slanted condition between a knocking member disposed at a side surface of an axial pipe and a sliding member disposed slidably in the axial pipe. When the knocking member is pressed, by the rotation of the outward end of the linking pawl, the linking pawl entirely moves forward in the axial direction, whereby the slanting angle of the linking pawl which presses the sliding member upon pressing of the knocking member will become gradually small, the frictional resistance between the sliding member and the axial pipe will be gradually reduced, and the knocking member can be operated with a relatively small pressing force. In addition, since the linking pawl itself moves sliding member in the axial direction, the movement of the sliding member can be increased, the structure of the writing instrument can be simplified, and the side knocking-type writing instrument can be manufactured at a low cost.

From the foregoing description, it can be seen that the present invention comprises an improved side knocking-type writing instrument. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

I claim:

1. A side knocking-type writing instrument comprising: a barrel having a longitudinal axis, a front end, and a rear end; a sliding member for supporting a writing component and being disposed in the barrel for undergoing forward and rearward sliding movement along the longitudinal axis of the barrel, the sliding member having a shoulder comprised of a generally L-shaped side wall having a first wall portion extending along the longitudinal axis and a second wall portion extending transversely to the longitudinal axis; a knocking member mounted for pivotal movement in a direction transverse to the longitudinal axis of the barrel about a fulcrum point disposed at a rear portion of the knocking member, the knocking member having a pressing portion disposed at a front portion thereof; and a linking pawl disposed between the knocking member and the sliding member for undergoing pivotal movement therebetween and axial movement along the longitudinal axis, the linking pawl having an outward end disposed in contact with the pressing portion of the knocking member and an inward end disposed in contact with the shoulder of the sliding member; wherein when the pressing portion of the knocking member is pressed, the knocking member undergoes movement in the transverse direction so that the linking pawl is moved axially while being pivoted and the sliding member is slid forwardly to thereby protrude the writing component from the front end of the barrel.

2. A side knocking-type writing instrument according to claim 1; wherein the linking pawl is generally L-shaped.

3. A side knocking-type writing instrument according to claim 1; wherein the knocking member has a seat portion receiving the outward end of the linking pawl.

4. A side knocking-type writing instrument according to claim 1; further comprising a flexible hinge portion connecting the outward end of the linking pawl to the pressing portion of the knocking member.

5. A side knocking-type writing instrument according to claim 1; further comprising a flexible hinge portion connecting the inward end of the linking pawl to the sliding member.

6. A side knocking-type writing instrument according to claim 1; further comprising a first flexible hinge portion connecting the outward end of the linking pawl to the pressing portion of the knocking member, and a second flexible hinge portion connecting the inward end of the linking pawl to the sliding member.

7. A side knocking-type writing instrument according to claim 1; wherein the writing component is a pencil lead.

8. A side knocking-type writing instrument according to claim 7; wherein the sliding member has a lead passageway hole for storing a plurality of pencil leads.

9. A side knocking-type writing instrument according to claim 1; wherein the sliding member has a slider main body, a projection formed on a side surface of the slider main body for engagement with a slide groove formed in an inner wall of the barrel, a receiving plate disposed at a rear portion of the slider main body and having a receiving port for receiving the writing component, and a guide plate disposed at a front portion of the slider main body for guiding the sliding movement of the sliding member along the longitudinal axis of the barrel.

10. A side knocking-type writing instrument according to claim 1; wherein the knocking member is generally U-shaped and has a pair of side plates and a transverse plate connecting the pair of side plates and having the pressing portion.

11. A side knocking-type writing instrument according to claim 1; wherein the linking pawl has a pair of leg pieces each having a respective inward end, and a connecting part connecting upper ends of the leg pieces and having the outward end.

12. A side knocking-type writing instrument according to claim 11; wherein the outward end and each of the inward ends of the linking pawl is generally arcuate-shaped.

13. A side knocking-type writing instrument comprising: a barrel having a longitudinal axis, a front end, and a rear end; a sliding member for supporting a writing component and being disposed in the barrel for undergoing forward and rearward sliding movement along the longitudinal axis of the barrel; a knocking member mounted for pivotal movement in a direction transverse to the longitudinal axis of the barrel about a fulcrum point disposed at rear portion of the knocking member, the knocking member having a pressing portion disposed at a front portion thereof; a linking pawl disposed between the knocking member and the sliding member for undergoing pivotal movement therebetween and axial movement along the longitudinal axis, the linking pawl having an outward end disposed in contact with a pressing portion of the knocking member and an inward end disposed in contact with the sliding member; and a flexible hinge portion connecting the outward end of the linking pawl to the pressing portion of the knocking member; wherein when the pressing portion of the knocking member is pressed, the knocking member undergoes movement in the transverse direction so that the linking pawl is moved axially while being pivoted and the sliding member is slid forwardly to thereby protrude the writing component from the front end of the barrel.

* * * * *